US010150599B2

(12) United States Patent
Julien et al.

(10) Patent No.: US 10,150,599 B2
(45) Date of Patent: Dec. 11, 2018

(54) TAMPER EVIDENT CAP

(71) Applicant: Mauser-Werke GmbH, Bruehl (DE)

(72) Inventors: Robert Alan Julien, Naperville, IL (US); Adam Donald Julien, Oswego, IL (US)

(73) Assignee: Mauser-Werke GmbH, Bruehl (DE)

( * ) Notice: Subject to any disclaimer, the term of this patent is extended or adjusted under 35 U.S.C. 154(b) by 0 days.

(21) Appl. No.: 15/037,541

(22) PCT Filed: Feb. 6, 2015

(86) PCT No.: PCT/EP2015/000239
§ 371 (c)(1),
(2) Date: May 18, 2016

(87) PCT Pub. No.: WO2015/117761
PCT Pub. Date: Aug. 13, 2015

(65) Prior Publication Data

US 2016/0297582 A1 Oct. 13, 2016

Related U.S. Application Data

(60) Provisional application No. 61/936,984, filed on Feb. 7, 2014.

(51) Int. Cl.
*B65D 51/18* (2006.01)
*B65D 39/08* (2006.01)
(Continued)

(52) U.S. Cl.
CPC ..... *B65D 51/18* (2013.01); *B65D 39/082* (2013.01); *B65D 41/083* (2013.01); *B65D 41/17* (2013.01);
(Continued)

(58) Field of Classification Search
CPC ..... B65D 51/18; B65D 41/47; B65D 39/082; B65D 41/17; B65D 41/083;
(Continued)

(56) References Cited

U.S. PATENT DOCUMENTS

2004/0045965 A1* 3/2004 Dwinell ..... B65D 39/08 220/257.2
2004/0144786 A1* 7/2004 Chmela ..... B65D 51/18 220/257.1
(Continued)

FOREIGN PATENT DOCUMENTS

CL 199600451 6/1998
CL 200201910 3/2004
(Continued)

OTHER PUBLICATIONS

International Search Report for corresponding PCT Application No. PCT/EP2015/000239, 3 pages, dated Jun. 30, 2015.
(Continued)

*Primary Examiner* — James N Smalley
(74) *Attorney, Agent, or Firm* — Timothy X. Gibson, Esq.; Gibson & Dernier LLP

(57) ABSTRACT

A tamper-evident cap (2) for engagement to a container closure plug (100), the cap including a panel (10) having a container closure plug-facing side and a preweakened region defining a tear strip (17), the tear strip having a tear strip pin (30) extending from the closure plug-facing side and configured for receipt by the container closure plug, a sidewall (12) extending from the closure plug-facing side, and a center post (20) extending axially from a central region of the panel, wherein the center post is configured to engage the container closure plug, the center post having a post preweakened region.

20 Claims, 5 Drawing Sheets

(51) Int. Cl.
*B65D 41/08* (2006.01)
*B65D 41/17* (2006.01)
*B65D 41/47* (2006.01)

(52) U.S. Cl.
CPC ..... *B65D 41/47* (2013.01); *B65D 2101/0023* (2013.01); *B65D 2101/0038* (2013.01); *B65D 2251/0015* (2013.01); *B65D 2251/0075* (2013.01)

(58) Field of Classification Search
CPC .... B65D 2251/0075; B65D 2251/0015; B65D 2101/0038; B65D 2101/0023
USPC ..... 220/661
See application file for complete search history.

(56) References Cited

U.S. PATENT DOCUMENTS

2005/0056645 A1* 3/2005 Buckley ..... B65D 39/08 220/257.1
2005/0121451 A1* 6/2005 Van Bruggen ..... B65D 39/082 220/257.2
2010/0282705 A1* 11/2010 Ledemeney ..... B65D 39/08 215/251
2010/0301046 A1 12/2010 Schuetz

FOREIGN PATENT DOCUMENTS

| | | | |
|---|---|---|---|
| CL | 200503103 | | 11/2006 |
| CL | 200601423 | | 3/2007 |
| CL | 200800483 | | 4/2008 |
| CL | 200900988 | B1 | 4/2010 |
| CN | 202848316 | U | 4/2013 |
| DE | 3637644 | A1 | 5/1988 |
| DE | 102009022800 | B3 | 8/2010 |
| EP | 1514806 | A2 | 3/2005 |
| WO | 2005056411 | A1 | 6/2005 |
| WO | 2012085942 | A1 | 6/2012 |

OTHER PUBLICATIONS

First Office Action for corresponding CN Application No. I 201580007553.2, 13 pages, dated Sep. 1, 2018.
Office Action for corresponding Chilean Application No. 201601978 dated Aug. 5, 2016 and statement of relevant documents.

* cited by examiner

TAMPER EVIDENT CAP

FIELD OF THE INVENTION

The invention relates to the field of tamper-evident devices for container closures. More specifically, the present invention relates to tamper-evident caps for container closure plugs.

BACKGROUND OF THE INVENTION

Containers such as drums with closure plugs may be employed for storage and/or transportation of a variety of materials, some of which may be hazardous and/or valuable. It is therefore useful for such containers to be sealed in a manner which prevents undetectable access.

SUMMARY OF THE INVENTION

Disclosed are tamper-evident caps configured to be fitted to container closure plugs.

In accordance with one embodiment a tamper-evident cap is provided which includes tamper evident features. In accordance with a further embodiment a tamper-evident cap is provided which includes a tamper-evident tear strip and tamper-evident post. In accordance with yet a further embodiment a tamper-evident cap is provided which includes one or more tamper-evident tear seams.

In a further embodiment a tamper-evident cap for engagement to a container closure plug, the cap including a panel having a container closure plug-facing side and a preweakened region defining a tear strip, the tear strip having a tear strip pin extending from the closure plug-facing side and configured for receipt by the container closure plug, a sidewall extending from the closure plug-facing side, and a center post extending axially from a central region of the panel, wherein the center post is configured to engage the container closure plug, the center post having a post preweakened region. The sidewall may be disposed annularly along a periphery of the panel.

The preweakened region defining a tear strip may include at least two perforations, score lines, thinned regions of material having a reduced thickness relative to adjacent regions, or the like. The preweakened region may be defined by perforations, score lines etc. spaced apart evenly, i.e., in parallel. The tear strip pin is dimensioned to fit in a recess formed in the container closure plug and prevent rotation of the cap when the cap is engaged to the container closure plug. In some embodiments the tear strip includes a tab extending therefrom, for ease of handling by and providing a secure grip for a user. The tab may be of any useful form, such as but not limited to a ring having an opening sized to receive a finger of a user.

In another embodiment, the center post includes external threads for engaging internal threads of a container closure plug. The post preweakened region may be formed by, or of, for example, perforations, score line(s), or a thinned region of material, etc. The post preweakened region may be formed annularly between the panel and an externally threaded section of the center post. The external threads of the center post are configured to snap-fit into an internal threaded section of the container closure plug and be removable from the container closure plug by rotational movement.

In further embodiments, the tamper-evident cap may include at least one preweakened seam defining an edge tamper-evident feature positioned on the periphery of the cap. The preweakened seam(s) may be formed by, or of, for example, perforations, score line(s), or a thinned section of material, etc., formed in the panel and the sidewall. In some embodiments the tamper-evident cap includes plural preweakened seams.

In another embodiment, a container closure assembly is disclosed including a closure plug configured to engage an opening of a container to close the opening and a tamper-evident cap for engagement to the container closure plug, the cap including a panel having a container closure plug-facing side and a preweakened region defining a tear strip, the tear strip having a tear strip pin extending from the closure plug-facing side and configured for receipt in a recess formed in the container closure plug, a sidewall extending from the closure plug-facing side, and a center post extending axially from a central region of the panel, wherein the center post is configured to engage the container closure plug, the center post including a post preweakened region.

In yet a further embodiment, a tamper-evident cap for engagement to a container closure plug is disclosed, the cap having a panel including a container closure plug-facing side and a preweakened region defining a tear strip, the tear strip having a tear strip pin extending from the closure plug-facing side and configured to fit in a recess formed in the container closure plug and prevent rotation of the cap when the cap is engaged to the container closure plug, a sidewall extending from the closure plug-facing side, and a center post extending axially from a central region of the panel, wherein the center post is configured to engage the container closure plug, the center post including a post preweakened region formed annularly between the panel and an externally threaded section of the center post, and at least one preweakened seam defining an edge tamper-evident feature positioned on the periphery of the cap.

Given above is a simplified summary in order to provide a basic understanding of some aspects described herein. This summary is not an extensive overview, and is not intended to identify key/critical elements or to delineate the scope of the claimed subject matter.

Embodiments of the tamper evident cap are disclosed in the accompanying drawings and description.

BRIEF DESCRIPTION OF THE DRAWINGS

So that those having ordinary skill in the art will have a better understanding of how to make and use the disclosed systems and methods, reference is made to the accompanying figure wherein.

DETAILED DESCRIPTION OF THE INVENTION

The following is a detailed description of the invention provided to aid those skilled in the art in practicing the present invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein. Unless otherwise indicated or defined, all technical and scientific terms used herein have the same meaning as commonly understood by one of ordinary skill in the art to which the invention pertains. The terminology used herein is for describing particular embodiments only and is not intended to be limiting.

Well-known functions or constructions may not be described in detail for brevity and/or clarity.

Figure 1:
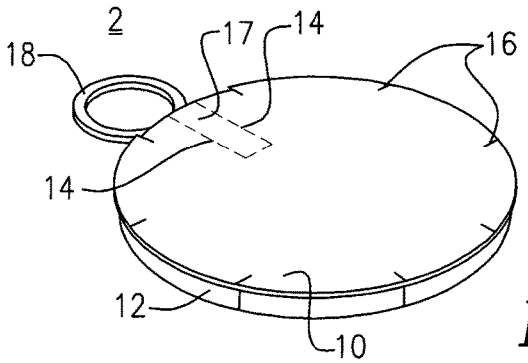
FIG. 1 is a top perspective view of a tamper-evident cap, with preweakened regions (element 14) shown in phantom, in accordance with an embodiment of the disclosed subject matter.
Figure 2:
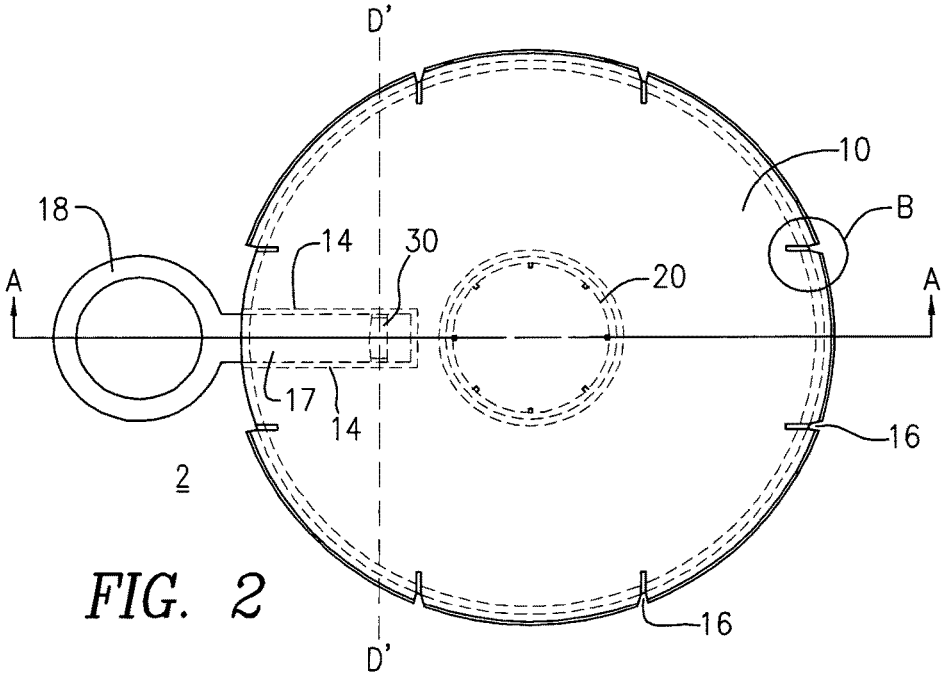
FIG. 2 is a top plan view of a tamper evident cap, with several features shown in phantom, in accordance with an embodiment of the disclosed subject matter.
Figure 2A:
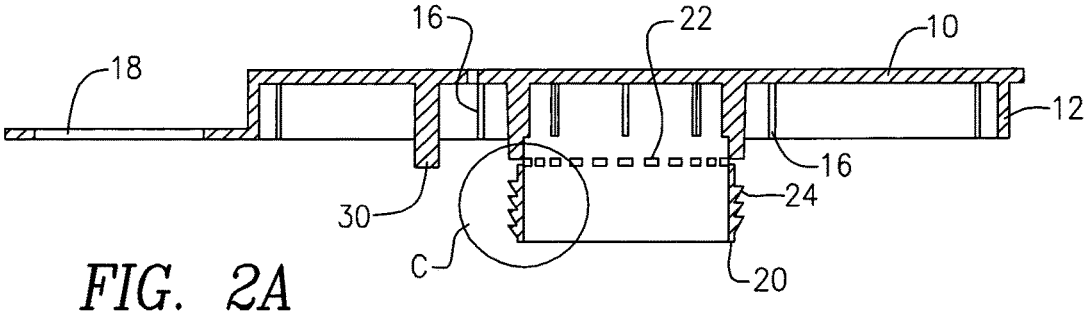
FIG. 2A is a side cross-sectional view of the tamper-evident cap according to FIG. 2, taken along line A-A'.

Referring to FIGS. 1-2A, a tamper-evident cap 2 includes a top panel 10, sidewall 12, top panel preweakened regions 14, tear seams 16, tear strip 17, center post 20, post preweakened region 22, and tear strip pin 30. The cap 2 may be molded or otherwise formed of plastic.

Top panel 10 forms a closure surface of the cap 2 and may be any suitable dimension and shape. Preweakened regions 14 formed in the top panel 10 define a tear strip 17. Preweakened regions 14 may be formed of perforations, score lines, thinned regions of the top panel relative to adjacent panel regions, etc.

Figure 2B:
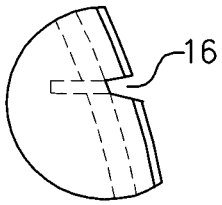
FIG. 2B is an enlarged view of detail B of FIG. 2.

Sidewall 12 depends from a perimeter of the top panel and may form an annular or semi-annular wall. With further reference to FIG. 2B, tear seams 16 may be formed along the perimeter of the top panel 10 and extend to sidewall 12.

Figure 2C:
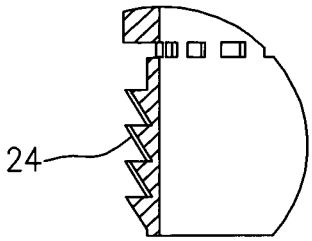
FIG. 2C is an enlarged view of detail C of FIG. 2A.

Center post 20 extends from a central region of the top panel 10 and includes a post threaded region 24 and post preweakened region 22. Post preweakened region 22 may include perforations, score lines or a thinned web or region of material having a reduced thickness compared to adjacent post regions formed on the center post 20. With further reference to FIG. 2C, post preweakened region 22 may be disposed between the top panel and the post threaded region 24.

Figure 3:
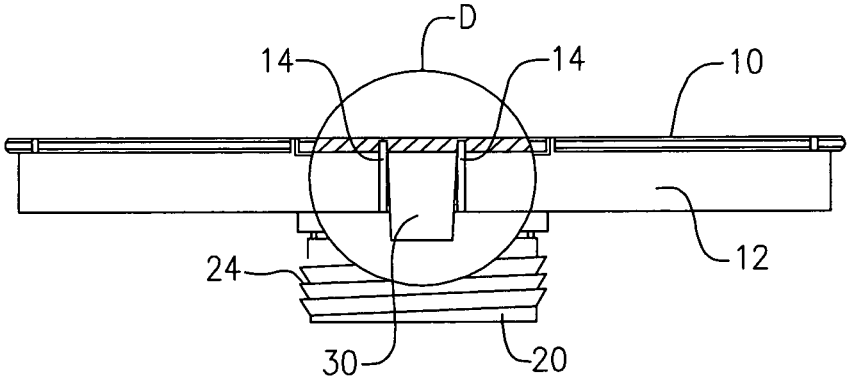
FIG. 3 is a side view of a tamper-evident cap with a partial cross section through line D'-D' in accordance with an embodiment of the disclosed subject matter.
Figure 3A:
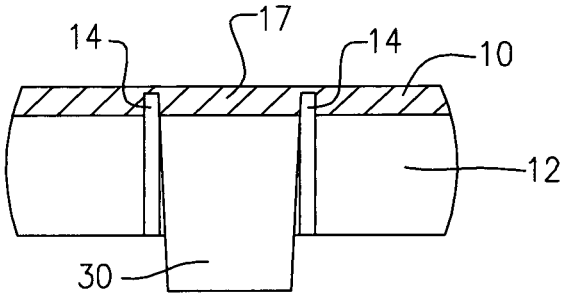
FIG. 3A is an enlarged view of detail D of FIG. 3.

With further reference to FIGS. 3 and 3A, tear strip pin 30 extends from tear strip 17.

Figure 4:
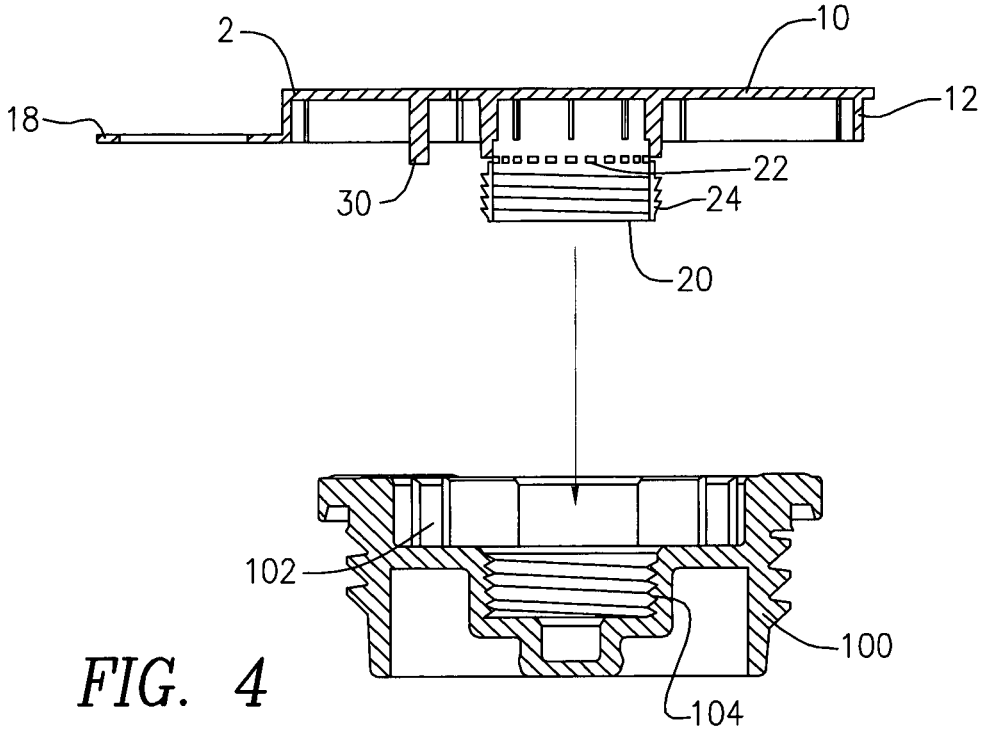
FIG. 4 is a side cross-sectional view of a tamper-evident cap positioned relative to a bung closure device in accordance with one embodiment of the disclosed subject matter.
Figure 5:
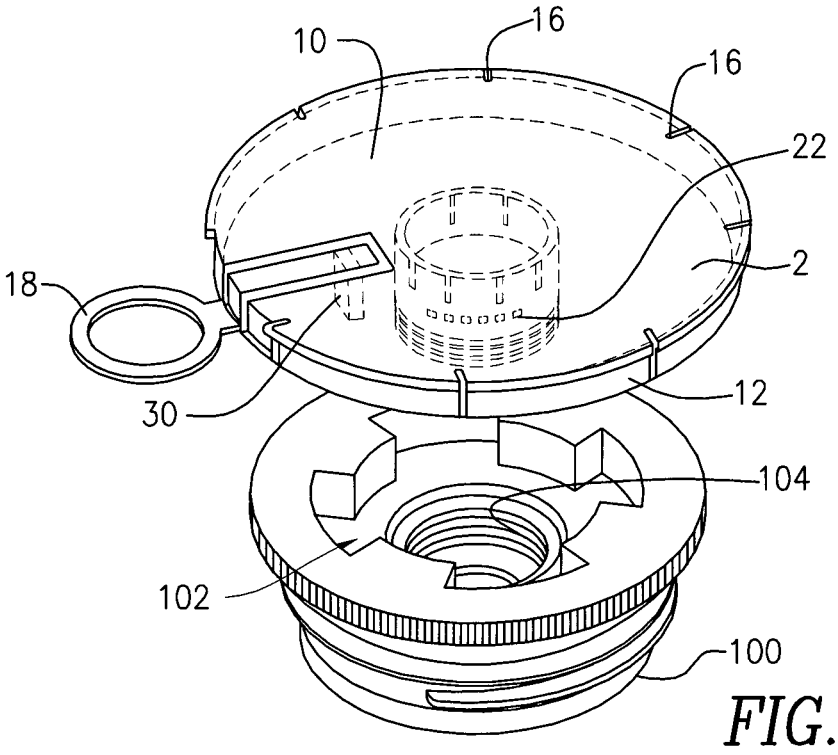
FIG. 5 is a top perspective view of a tamper-evident cap, with some elements shown in phantom, positioned relative to a bung closure device in accordance with one embodiment of the disclosed subject matter.
Figure 6:
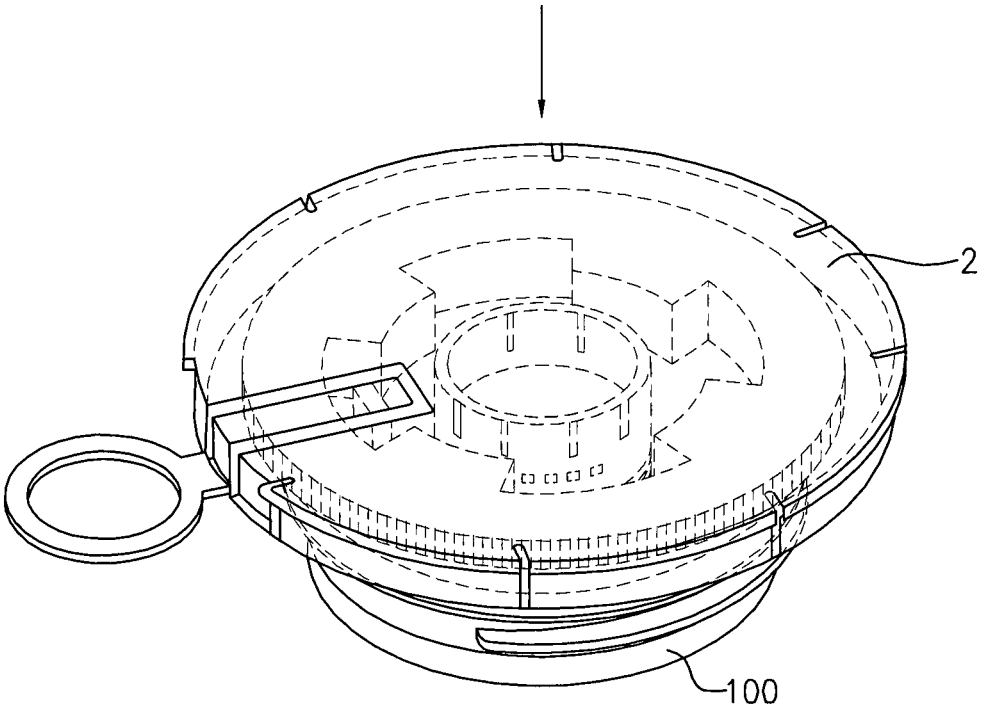
FIG. 6 is a top perspective view of a tamper-evident cap, with some elements shown in phantom, with an illustrative directional arrow demonstrating the tamper-evident cap may be engaged to the bung closure by application of downward force in accordance with one embodiment of the disclosed subject matter.

With further reference to FIG. 4, in accordance with an embodiment, the tamper-evident cap 2 may be employed in conjunction with commercially available container closures such as bung closure plugs. With further reference to FIGS. 5-6, tear strip pin 30 extending from tear strip 17 is configured to engage a recessed lug area 102 of a plug 100. Post threaded region 24 is configured to engage a threaded core 104 of the plug 100. In one embodiment center post 20 is generally cylindrical in shape and includes post threaded region 24 disposed at an external surface of an annular wall thereof. As shown in FIG. 2C, the post threaded region 24 may include threads having a leading edge configured to permit the center post 20 to be snap-fit into a threaded core 104 of the plug 100, and a trailing edge that prevents removal without rotational movement of the cap 2.

Installation of the tamper-evident cap 2 on plug 100 is achieved by aligning the tear strip pin 30 with a recessed lug area 102 of a plug 100 and the center post 20 with the threaded core 104 of the plug 100. Once the components are aligned, downward pressure on the tamper-evident cap 2 cap seal onto the plug 100 engages the tamper-evident cap 2 with plug 100 by a snap-fit between the threaded region 24 and threaded core 104 of the plug.

Figure 7:
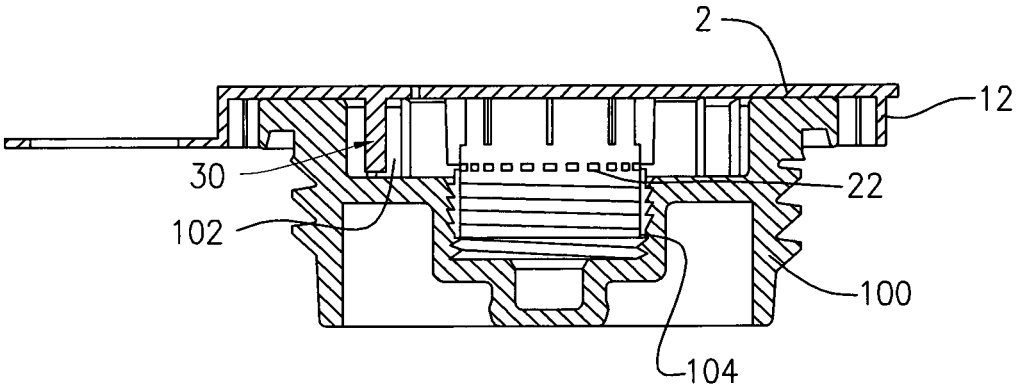
FIG. 7 is a side cross-sectional view of a tamper-evident cap engaged to a bung closure device in accordance with one embodiment of the disclosed subject matter.

With reference to FIGS. 2-3 and 7, a first tamper-evident feature of the tamper-evident cap 2 resides in the tear strip 17 and tear strip pin 30 extending from the tear strip 17. The tear strip pin 30 locks the cap 2 in the plug 100 by preventing rotational movement of the cap 2 when the cap 2 is installed on the plug 100. The only way to remove the cap 2 by rotational movement, that is, unscrewing the center post 20 from the threaded core 104 of the plug 100, is to remove the tear strip 17, which removes the tear strip pin 30 from the lug recess 104 of plug 100 and thereby removes the impediment to unscrewing the cap 2 from the plug 100.

A second tamper-evident feature of the tamper-evident cap 2 resides in the post preweakened region 22 of the center post 20. As noted, post preweakened region 22 may include perforations, score lines or a thinned web or region of material having a reduced thickness compared to adjacent post regions formed on the center post 20 of the cap 2. Any attempt to pull the cap 2 out of the threaded core 104 (rather than unscrewing the cap 2 from the plug 100) will result in a visual indication of stress, plastic stretching, or tearing of the post preweakened region 22. If the cap 2 is pulled hard enough to tear the post preweakened region 22 the cap 2 will come off, leaving only the portion of the center post 20 including threaded region 24 inside the threaded core 104 of the plug 100.

Figure 8:
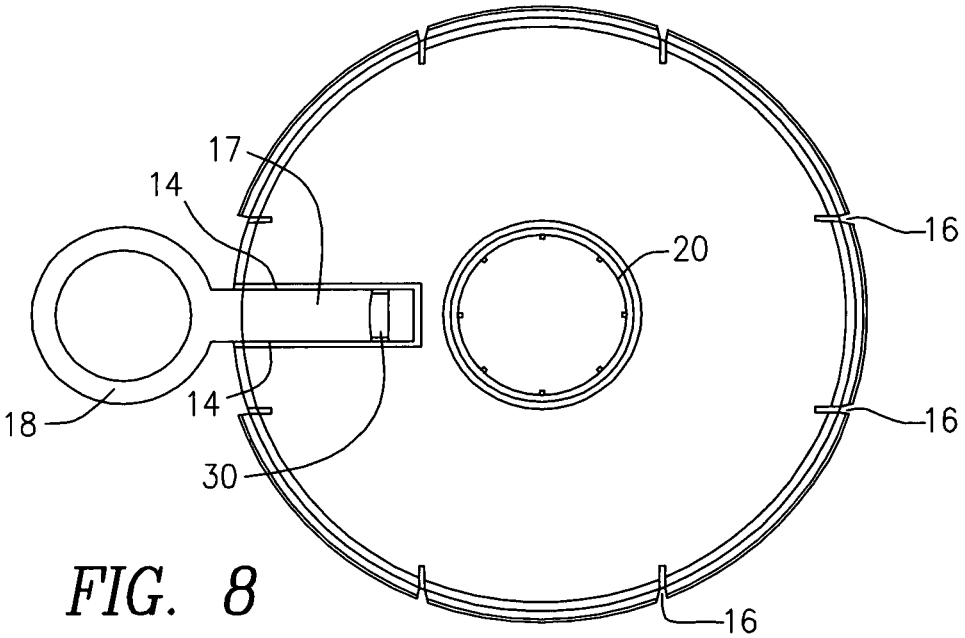
FIG. 8 is a bottom plan view of a tamper evident cap in accordance with an embodiment of the disclosed subject matter.

With reference to FIGS. 2, 2B and 8, a third tamper-evident feature of the tamper-evident cap 2 resides in the tear seams 16 disposed along the periphery of the cap 2. Tear seams 16 may include perforations, score lines or a thinned web of material having a reduced thickness compared to adjacent regions formed on the edge of the top surface 10 and sidewall 12 of the cap 2. The tear seams 16 are configured and operable to reveal stress in the event someone tries to pull the cap 2 off the plug 100 by grabbing under the sidewall 12 of the cap 2. Application of upward force on the cap 2 such as would be applied in the case of an attempted removal would tear some or all of the tear seams 16. In one embodiment the cap 2 includes eight tear seams 16, however, it will be apparent to those skilled in the art more or fewer tear seams 16 may be employed.

Figure 9:
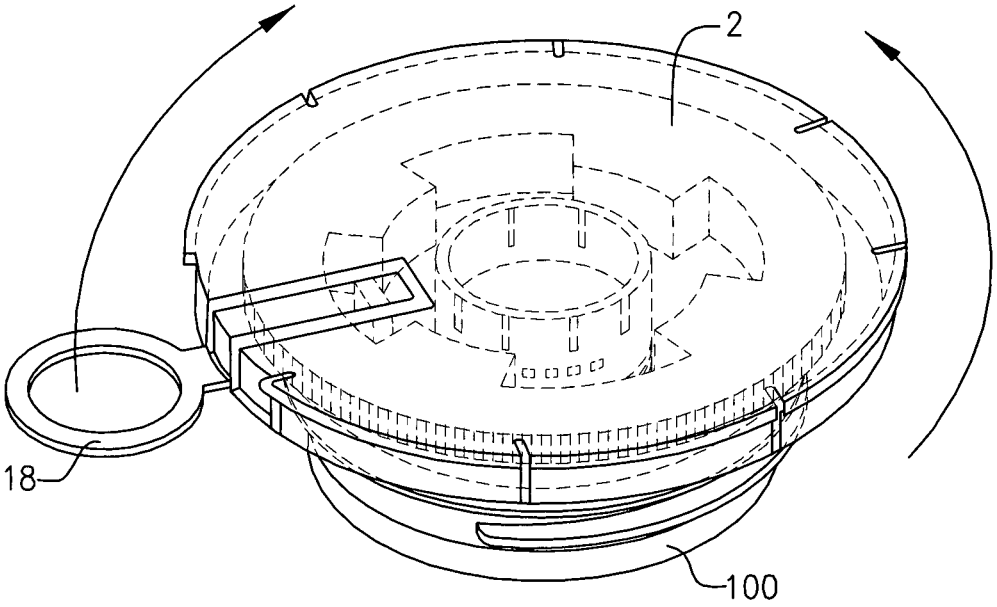
FIG. 9 is a top perspective view of a tamper-evident cap, with some elements shown in phantom, with illustrative directional arrows demonstrating the tamper-evident cap may be removed from a bung closure by application of upward force on the tab feature and rotational force applied to the cap in accordance with one embodiment of the disclosed subject matter.

With further reference to FIG. 9, removal of the tamper-evident cap 2 from a plug 100 is properly achieved by removal of the tear strip 17 from the cap 2 and subsequently unthreading the cap 2 from the plug 100. In one embodiment, to facilitate the removal of the tear strip 17, cap 2 includes a tab 18 extending from the tear strip. Tab 18 may include an opening sized to receive a finger of a user. A user may place a finger in the tab 18 and pull up and toward the center of the cap 2, as indicated by the arrow, until the tear strip pin 30 is removed from the recess lug 102 of plug 100. Once the tear strip pin 30 is removed from the recess lug 102, rotation of the cap 2 in the unthreading direction (as indicated by the arrow) is operable to unthread the cap 2 from the plug 100.

Although the disclosure herein has been described with reference to particular embodiments, it is to be understood that these embodiments are merely illustrative of the principles and applications of the embodiments herein. It is therefore to be understood that numerous modifications may be made to the illustrative embodiments and that other arrangements may be devised without departing from the spirit and scope of the present application. All publications, patent applications, patents, figures and other references mentioned herein are expressly incorporated by reference in their entirety.

What is claimed is:

1. A tamper-evident cap for engagement to a container closure plug, the cap comprising a panel comprising a container closure plug-facing side and a preweakened region defining a tear strip, the tear strip comprising a tear strip pin extending from the closure plug-facing side and configured for receipt by the container closure plug, a sidewall extending from the closure plug-facing side, and a center post extending axially from a central region of the panel, wherein the center post is configured to engage the container closure plug, the center post comprising a post preweakened region.

2. The tamper-evident cap of claim 1 wherein the sidewall is disposed annularly along a periphery of the panel.

3. The tamper-evident cap of claim 1 wherein the preweakened region defining a tear strip comprises at least two perforations, score lines or thinned regions of material.

4. The tamper-evident cap of claim 1 wherein the tear strip pin is dimensioned to fit in a recess formed in the container closure plug and prevent rotation of the cap when the cap is engaged to the container closure plug.

5. The tamper-evident cap of claim 1 comprising a tab extending from the tear strip.

6. The tamper-evident cap of claim 5 wherein the tab comprises an opening sized to receive a finger of a user.

7. The tamper-evident cap of claim 1 wherein the center post comprises external threads.

8. The tamper-evident cap of claim 1 wherein the post preweakened region comprises a perforation, score line or thinned region of material.

9. The tamper-evident cap of claim 1 wherein the preweakened region is formed annularly between the panel and an externally threaded section of the center post.

10. The tamper evident cap of claim 7 wherein the external threads of the center post are configured to snap-fit into an internal threaded section of the container closure plug and be removable from the container closure plug by rotational movement.

11. The tamper-evident cap of claim 1 further comprising at least one preweakened seam defining an edge tamper-evident feature positioned on the periphery of the cap.

12. The tamper-evident cap of claim 11 wherein the at least one preweakened seam comprises perforations, a score line or thinned region of material formed in the panel and the sidewall.

13. The tamper-evident cap of claim 11 comprising plural preweakened seams.

14. A container closure assembly comprising a closure plug configured to engage an opening of a container to close said opening and a tamper-evident cap for engagement to the container closure plug, the cap comprising a panel comprising a container closure plug-facing side and a preweakened region defining a tear strip, the tear strip comprising a tear strip pin extending from the closure plug-facing side and configured for receipt in a recess formed in the container closure plug, a sidewall extending from the closure plug-facing side, and a center post extending axially from a central region of the panel, wherein the center post is configured to engage the container closure plug, the center post comprising a post preweakened region.

15. The container closure assembly of claim 14 wherein said center post comprises external threads.

16. The container closure assembly of claim 15 wherein said closure plug includes internal threads dimensioned to receive at least one of the external threads via a snap-fit engagement.

17. A tamper-evident cap for engagement to a container closure plug, the cap comprising a panel comprising a container closure plug-facing side and a preweakened region defining a tear strip, the tear strip comprising a tear strip pin extending from the closure plug-facing side and configured to fit in a recess formed in the container closure plug and prevent rotation of the cap when the cap is engaged to the container closure plug, a sidewall extending from the closure plug-facing side, and a center post extending axially from a central region of the panel, wherein the center post is configured to engage the container closure plug, the center post comprising a post preweakened region formed annularly between the panel and an externally threaded section of the center post, and at least one preweakened seam defining an edge tamper-evident feature positioned on the periphery of the cap.

18. The tamper-evident cap of claim 17 wherein the at least one preweakened seam comprises perforations, a score line or thinned region of material formed in the panel and the sidewall.

19. The tamper-evident cap of claim 17 comprising plural preweakened seams.

20. The tamper evident cap of claim 17 wherein the external threads of the center post are configured to snap-fit into an internal threaded section of the container closure plug and be removable from the container closure plug by rotational movement.

* * * * *